US010106376B2

(12) United States Patent
Del Pozo Polidoro et al.

(10) Patent No.: US 10,106,376 B2
(45) Date of Patent: Oct. 23, 2018

(54) DEVICE FOR HOISTING AND CONTROLLING LOADS

(71) Applicant: AIRBUS DEFENCE AND SPACE, S.A., Getafe (ES)

(72) Inventors: Enrique Del Pozo Polidoro, Sevilla (ES); Manuel Pérez López, Sevilla (ES); Fernando Esteban Finck, Getafe (ES)

(73) Assignee: Airbus Defence and Space, S.A., Getafe (ES)

( * ) Notice: Subject to any disclaimer, the term of this patent is extended or adjusted under 35 U.S.C. 154(b) by 373 days.

(21) Appl. No.: 14/974,532

(22) Filed: Dec. 18, 2015

(65) Prior Publication Data

US 2016/0176682 A1 Jun. 23, 2016

(30) Foreign Application Priority Data

Dec. 19, 2014 (EP) ..... 14382543

(51) Int. Cl.
*B66C 1/10* (2006.01)
*B66C 13/08* (2006.01)

(52) U.S. Cl.
CPC ..... *B66C 1/10* (2013.01); *B66C 13/08* (2013.01)

(58) Field of Classification Search
CPC ..... B66C 1/10; B66C 13/08
See application file for complete search history.

(56) References Cited

U.S. PATENT DOCUMENTS 1,928,213 A * 9/1933 Showers, Jr. ..... B66C 1/101 294/81.2
3,596,968 A 8/1971 Holm
3,842,986 A * 10/1974 Hupkes ..... B66C 13/06 212/330
4,035,010 A * 7/1977 Kawashita ..... B66C 1/64 294/101

(Continued)

FOREIGN PATENT DOCUMENTS

| | | |
|---|---|---|
| EP | 2 551 474 | 1/2013 |
| GB | 1 243 049 | 8/1971 |
| NL | 6611354 | 11/1967 |

OTHER PUBLICATIONS

European Search Report dated Jun. 3, 2015.

(Continued)

*Primary Examiner* — Sang K Kim
*Assistant Examiner* — Nathaniel L Adams
(74) *Attorney, Agent, or Firm* — Dickinson Wright, PLLC

(57) ABSTRACT

In the field of hoisting and controlling hoisted loads, a hoisting device for hoisting a load includes a support beam, two load carrying units, structured to be slid along the support beam and being structured to hold the load, at least one counterweight structured to be slid along the support beam, at least one sensor capable of measuring the weight force held by the load carrying units, a first driving unit structured to slide the load carrying units, a second driving unit structured to slide the counterweight, a third driving unit structured to hoist the load, a hooking point structured to be hooked from a crane, and a processing unit structured to receive the information produced by the sensor and structured to operate the first driving unit, the second driving unit and the third driving unit.

9 Claims, 7 Drawing Sheets

(56) References Cited

U.S. PATENT DOCUMENTS

| | | | | |
|---|---|---|---|---|
| 4,350,254 | A * | 9/1982 | Noly | B66C 13/08 212/242 |
| 6,439,407 | B1 * | 8/2002 | Jacoff | B66C 13/06 212/272 |
| 7,478,852 | B1 * | 1/2009 | Durden | B66C 1/10 294/81.2 |
| 8,000,835 | B2 | 8/2011 | Friz | |
| 2010/0084201 | A1 * | 4/2010 | Wurst | B66C 13/08 177/147 |
| 2011/0221215 | A1 * | 9/2011 | Botwright | B66C 1/108 294/81.4 |
| 2013/0028699 | A1 | 1/2013 | Spanos | |

OTHER PUBLICATIONS

"Rotator Beam, automatic," Axzion. http://www.axzion.de/en/products/cross-beams/rotator-beam-a.html.
"Roll Lifting Beams," Tenova. http://www.tenova.com/product.asp?IDProdotto=218.
"Lifting Beams," airpes. https://www.airpes.com/product/lifting-beam/.

* cited by examiner

FIG. 2.1
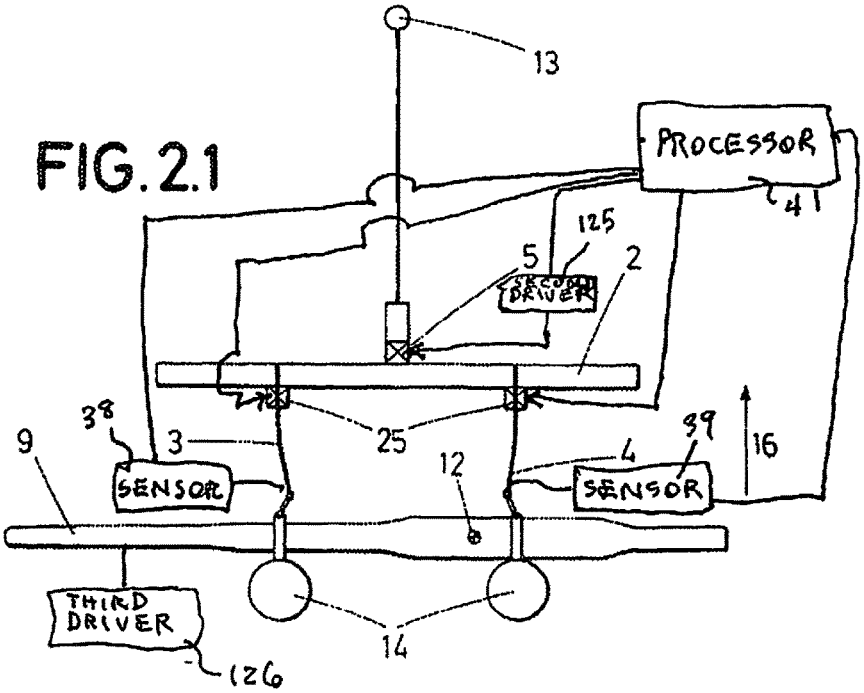
FIG. 2.2
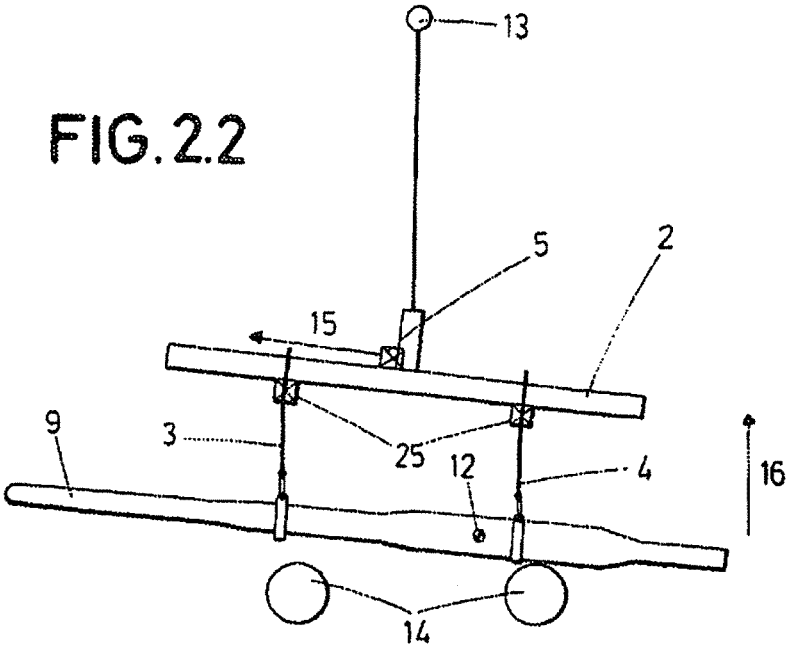

FIG. 2.3
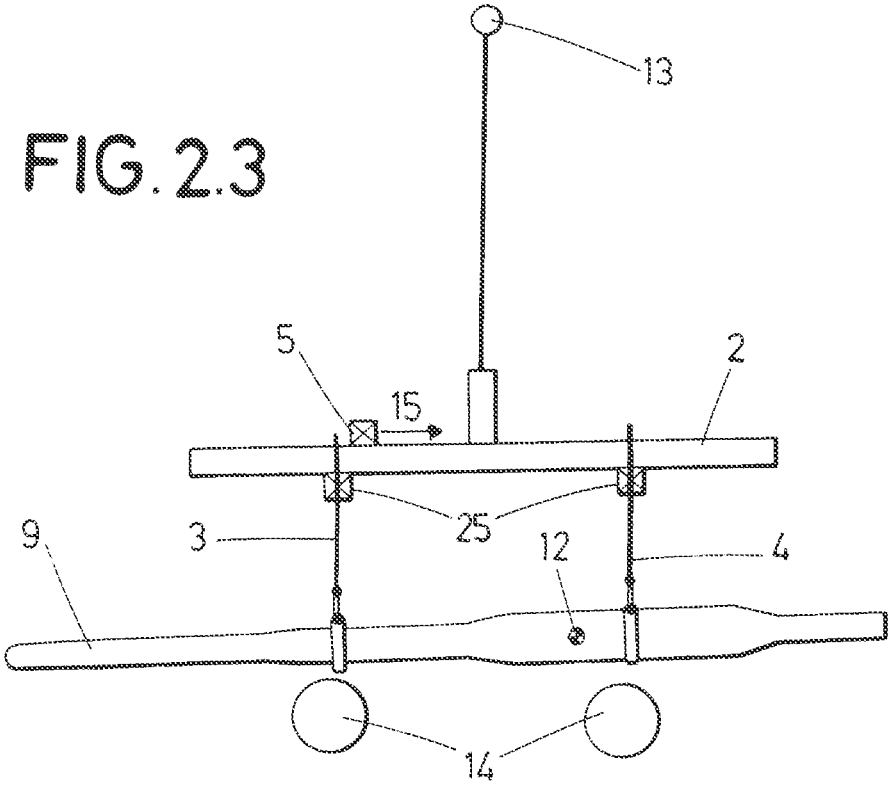
FIG. 2.4
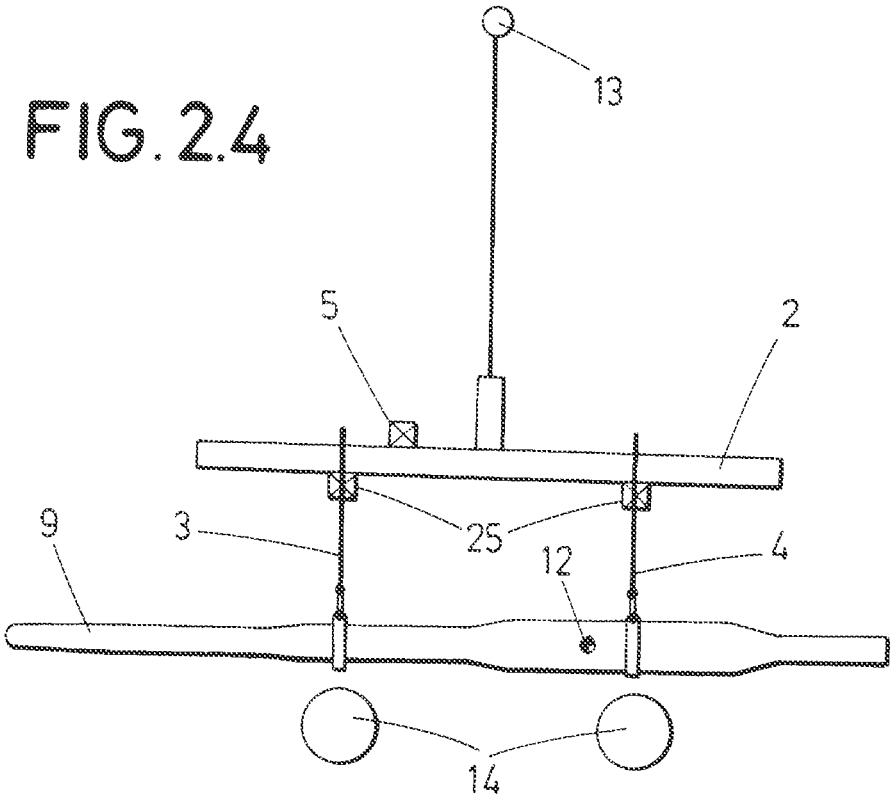

FIG.3
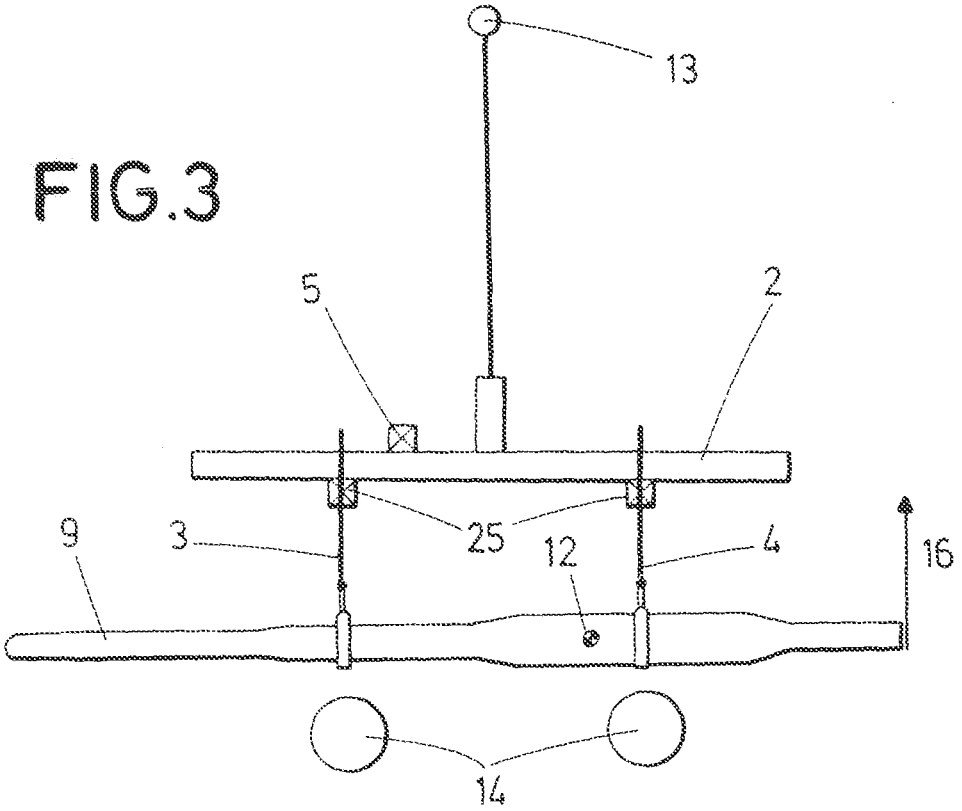
FIG.4.1
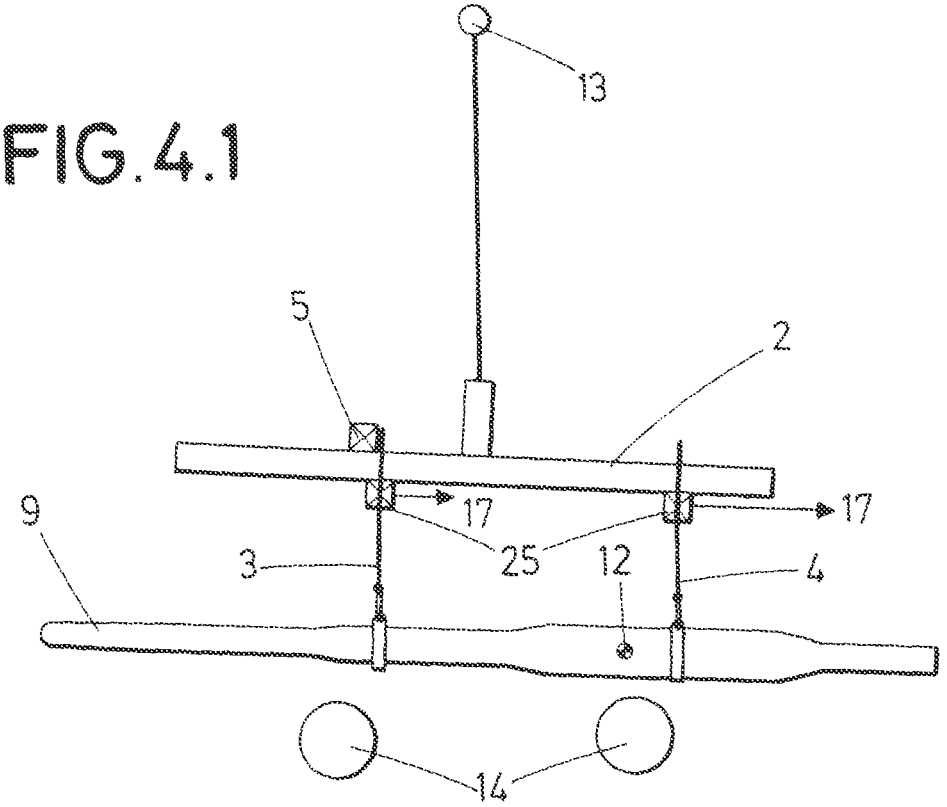

FIG. 4.2
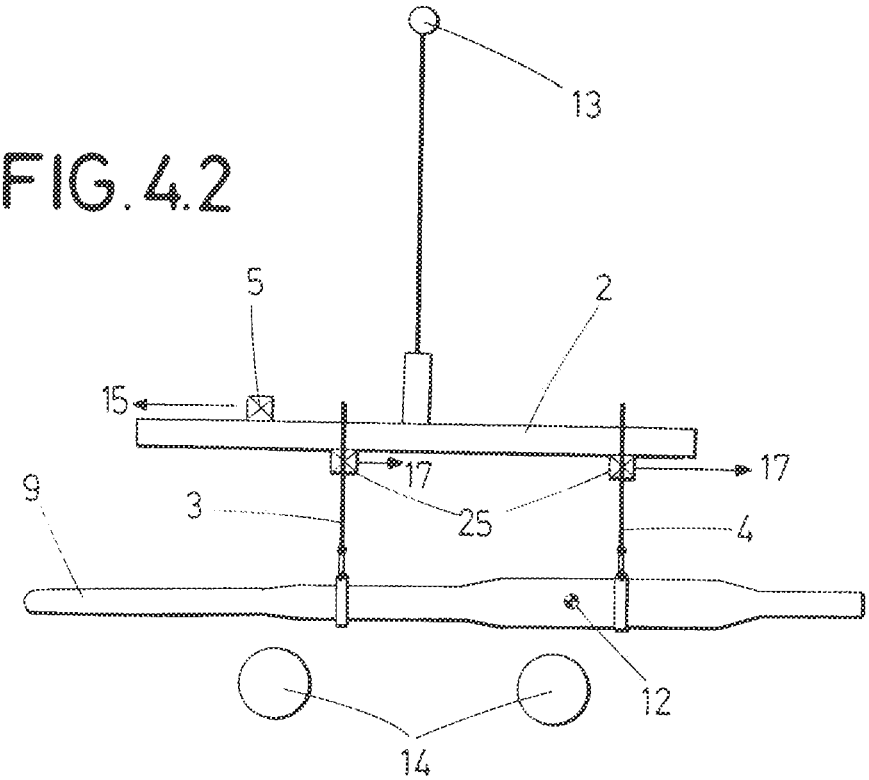
FIG. 5
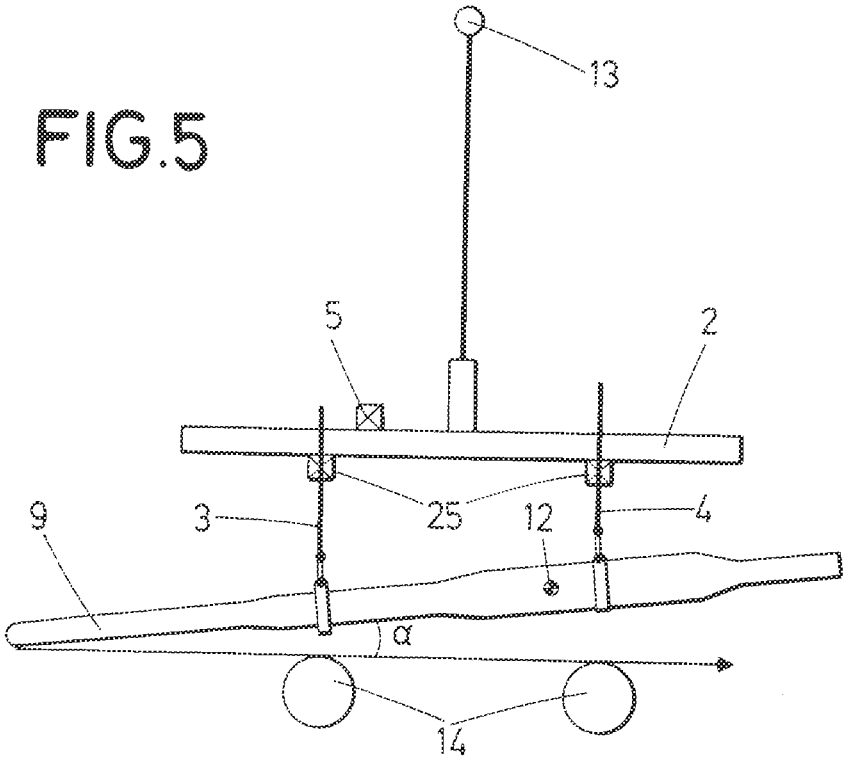

FIG.6.1
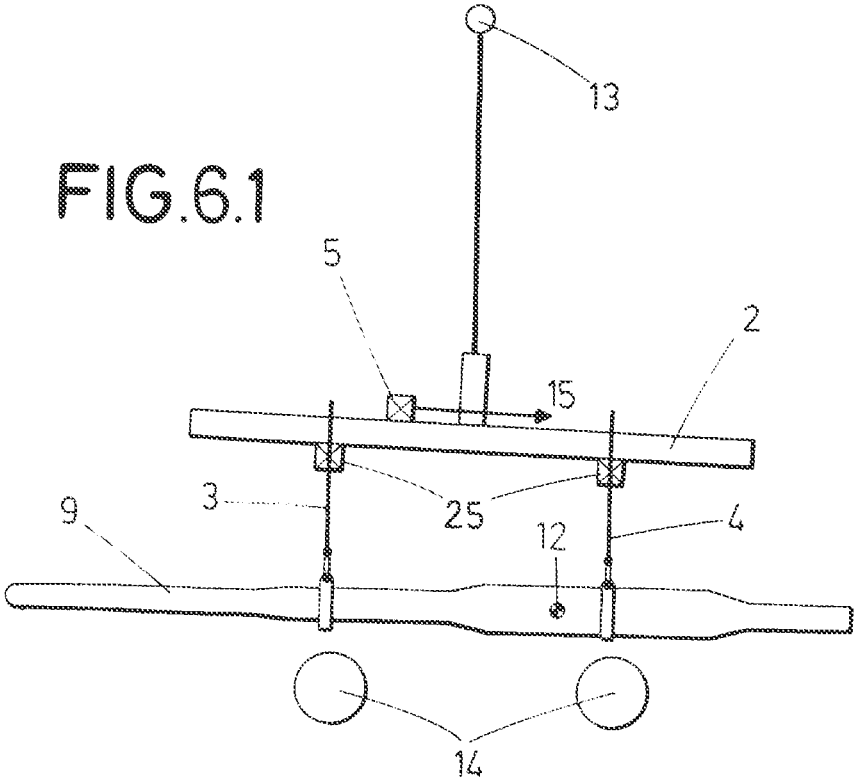
FIG.6.2
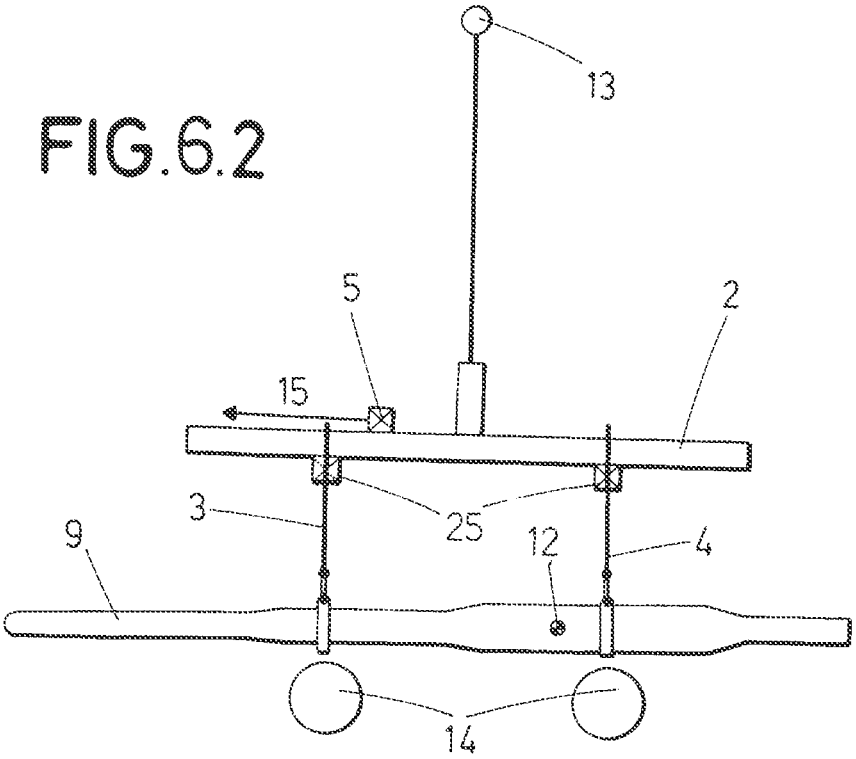

FIG. 6.3
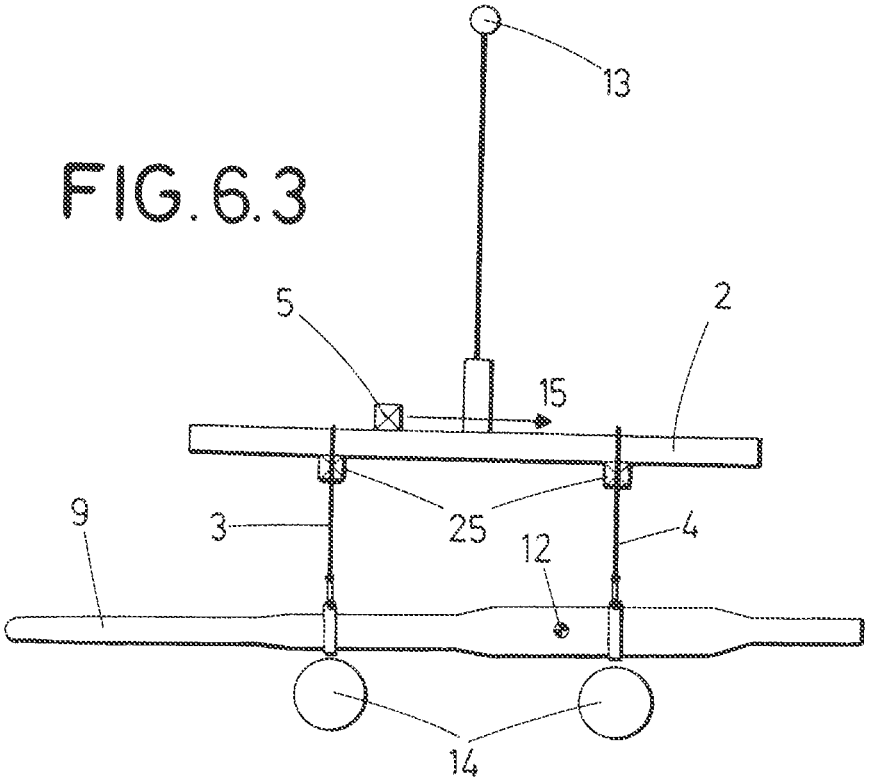
FIG. 6.4
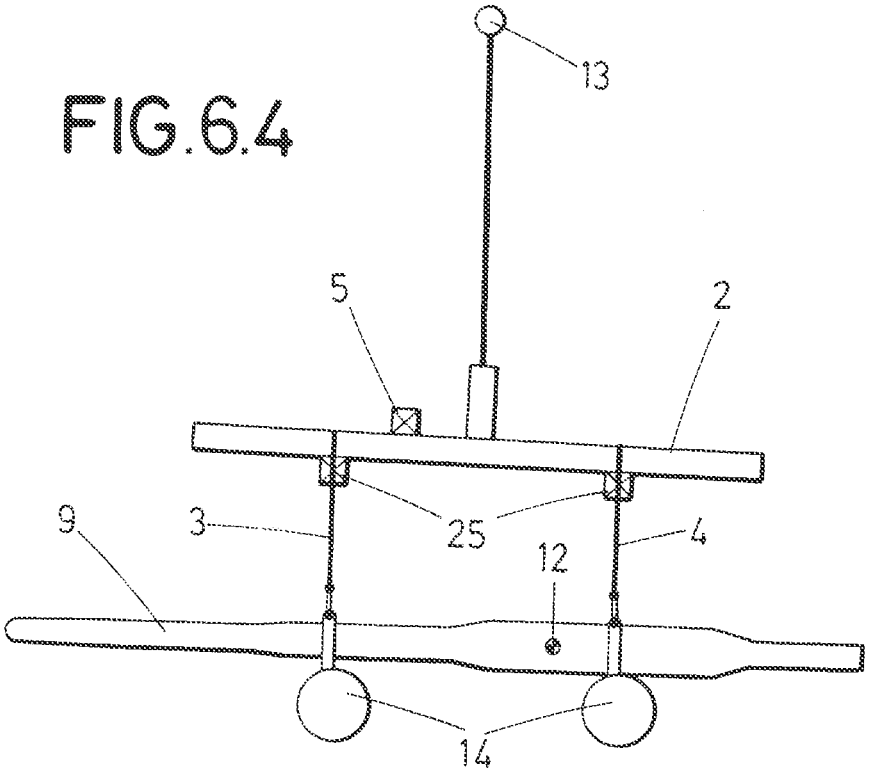

DEVICE FOR HOISTING AND CONTROLLING LOADS

CROSS REFERENCE TO RELATED APPLICATION

This application is entitled to and claims the benefit of European Application No. 14382543.8 filed Dec. 19, 2014, the disclosure of which, including the specification, claims, drawings and abstract, is incorporated herein by reference in its entirety.

FIELD

The present invention is related to the field of hoisting and controlling hoisted loads. In particular, the invention describes a load hoisting device structured to hoist and manage a load without previously knowing the position of its centre of mass.

BACKGROUND

Many devices adapted to hoist loads and control hoisted loads, such as cranes, bridge cranes, overhead cranes or tower cranes are already known in the state of the art.

In the particular field of hoisting and controlling heavy loads, such as aeronautical parts, the centre of mass of the part is not known or can even be variable when hoisted or if its position is changed. In these cases, the part would oscillate during the hoisting process, whenever the centre of mass is not vertically aligned with the hoisting point. These oscillations can damage either the crane or the part to be hoisted, or injure the operators working in the surrounding area.

U.S. Pat. No. 8,000,835B2 discloses an apparatus, a product, and related methods for gravity stabilizing a suspended load. The apparatus includes a centre of gravity stabilized automated adjusting load bar in communication with a mobile cart which allows an operator to enable automated stabilization of a load.

U.S. Pat. No. 3,596,968A discloses a hoisting apparatus for hoisting and controlling a three-dimensional load, particularly a module for a modular building.

These devices need to correct the position of the hoisting point before knowing where the centre of mass is located. The two-bridge structure of the disclosed devices adds complexity and weight to the hoisting system.

It would be thus desirable to find a device capable to hoist any load, via a single bridge structure, without previously knowing the location of its centre of mass.

SUMMARY

The present invention provides a solution for the aforementioned problems by a load hoisting device as defined in the attached claims. All the features described in this specification (including the claims, description and drawings) can be combined in any combination, with the exception of combinations of such mutually exclusive features.

In a first aspect of the invention there is provided a load hoisting device for hoisting a load, the hoisting device comprising:

- a support beam,
- two load carrying units, structured to be slid along the support beam and being structured to hold the load,
- at least one counterweight structured to be slid along the support beam,

- at least one sensor unit in each load carrying unit, each sensor unit being capable of measuring the weight force held by the load carrying unit,
- a first driving unit structured to make the load carrying unit slide along the support beam,
- a second driving unit structured to make the counterweight slide along the support beam,
- a third driving unit structured to hoist the load,
- a hooking point structured to be hooked from a crane, and
- a processing unit structured to receive the information produced by the sensor unit and structured to operate the first driving unit, the second driving unit and the third driving unit, in order to move the counterweight to a position such that the centre of mass of the system containing the load and the hoisting device is vertically aligned with the hooking point.

The vertical direction must be understood as the gravity direction.

The load carrying units are elements configured for carrying a load. In particular embodiments of the invention, these load carrying units are slings or cables.

The sensor units are elements configured for measuring particular parameters of position and/or orientation of the elements comprised in the load hoisting device. In particular embodiments of the invention, these sensor units are sensors.

The driving units are elements configured for making the load carrying units displace. In particular embodiments of the invention, these driving units are motors.

The processing units are elements configured for dealing with the information received and generating instructions to other elements of the load hoisting device. In particular embodiments of the invention, the processing unit is a processor.

The support beam is structured to support elements or devices attached in its structure. In one embodiment, the form of said support beam is a right prism, wherein the basis of the right prism is a regular polygon, preferably a square. Also said support beam is structured to maintain the integrity and the form of its structure even when said elements are heavy weight elements. In another embodiment, this support beam is made of iron or steel.

The load carrying units are structured to hoist at least one load and wherein the length of the movable load carrying unit is structured to be varied.

In a particular embodiment, the support beam further comprises a first rail, the load carrying unit being slidably arranged to this first rail, and a second rail, the counterweight being slidably arranged to this second rail.

In a particular embodiment, the second rail is located in the opposite side of the support beam with respect of the first rail.

In a particular embodiment, the hooking point is comprised in a hooking structure, which also comprises a protective structure.

In a particular embodiment, the first rail extends along substantially the whole length of the support beam.

In a particular embodiment, the second rail extends along substantially the whole length of the support beam.

In a particular embodiment, the at least two movable load carrying units are slings or cables.

In a particular embodiment, the load hoisting device comprise a further sensor unit being suitable for sensing position, or levelling or a combination thereof.

In a particular embodiment, the first driving unit, the second driving unit and the third driving unit are powered by a motor.

This device allows hoisting a load in a stable way, without taking account of the position of the centre of mass of the load and allows situating in a determined position of the XY plane; in this case an operator can work on the load or attach the load in use in a stable way.

BRIEF DESCRIPTION OF THE DRAWINGS

These and other characteristics and advantages of the invention will become clearly understood in view of the detailed description of the invention which becomes apparent from preferred embodiments of the invention, given just as an example and not being limited thereto, with reference to the drawings.

FIGS. 2.1, 2,2, 2,3, and 2.4 schematically illustrate an example of a use of a load hoisting device according to the invention.

FIG. 3 schematically illustrates a case of hoisting a load.

FIGS. 4.1 and 4.2 schematically illustrate another example of a use of a load management device according to the invention.

FIG. 5 schematically illustrates another example of use of a load hoisting device according to the invention.

FIGS. 6.1, 6.2, 6.3 and 6.4 schematically illustrates additional examples of uses of a load hoisting device according to the invention

DETAILED DESCRIPTION OF EMBODIMENTS

Figure 1:
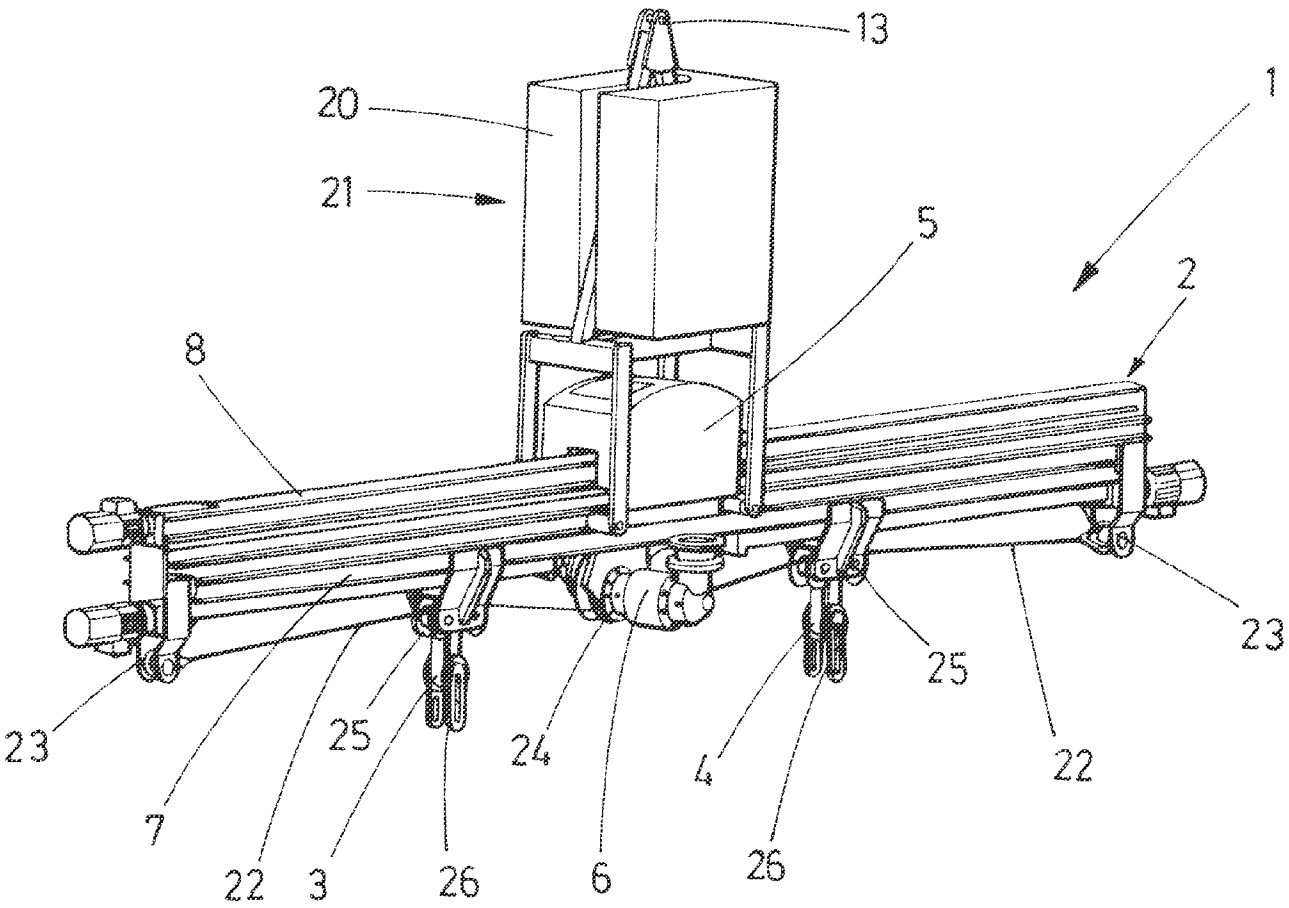
FIG. 1 shows an embodiment of a device according to the invention.

Once the object of the invention has been outlined, specific non-limitative embodiments are described hereinafter. The embodiments are referred to a hoisting device suitable for hoisting loads in a stable way and without a previous knowledge of the centre of mass of the load to be hoisted. The examples are oriented to hoist aeronautical parts.

FIG. 1 and FIGS. 2.1, 2,2, 2,3, and 2.4 show an embodiment of a hoisting device (1) according to the invention for hoisting a load (not shown in this figure). This hoisting device (1) comprises:

- a support beam (2),
- two load carrying units (3, 4), structured to be slid along the support beam (2) and being structured to hold the load (not shown in this figure),
- at least one counterweight (5) structured to be slid along the support beam (2),
- at least one sensor unit structured to measure the weight force held by the load carrying units (3, 4),
- first driving unit (25) structured to make the load carrying units (3, 4) slide along the support beam (2),
- second driving unit 125 (see FIG. 2.1) structured to make the counterweight (5) slide along the support beam (2),
- third driving unit 126 (see FIG. 2.1) structured to hoist the load (not shown in this figure),
- a hooking point (13) structured to be hooked from a crane, and
- a processing unit structured to receive the information produced by the sensor unit and structured to operate the first driving unit (25), the second driving unit 125 and the third driving unit 126, in order to move the counterweight (5) to a position such that the centre of mass of the system containing the load (not shown in this figure) and the hoisting device (1) is vertically aligned with the hooking point (13).

In this particular embodiment, the support beam (2) comprises a first rail (7) located in a part of the support beam (2) and a second rail (8), which is located in the opposite part of the support beam (2) with respect to the first rail (7). In the figure, the first rail (7) is shown in the bottom part of the support beam (2) and the second rail (8) is shown in the top part of the support beam (2).

The load carrying units (3,4) are slidably arranged to the first rail (7), such that they are structured to move slidably along this first rail (7). This movement is operated by the first driving unit (25), which are structured to move or retain each one of the load carrying units (3, 4). In a particular embodiment, the load carrying units (3, 4) are movable jointly; i.e., the first driving unit (25) apply the same movement to the load carrying units (3, 4) at the same time. In other embodiment, the load carrying units (3, 4) are movable independently form one another; i.e., the first driving unit (25) are configured for moving just one load carrying units (3, 4) or apply different movements in different moments to each one of the load carrying units (3, 4).

In the particular embodiment shown in this figure, the carrying units (3, 4) are slings. In another embodiment not shown in the figures, the carrying units (3, 4) are cables.

The counterweight (5) is slidably arranged to the second rail (8), being configured to move slidably along this second rail (8). This movement is operated by the second driving unit, which is structured to move or retain the counterweight (5).

Further, the third driving unit is structured to act on the load carrying units (3, 4) exerting a hoisting force suitable for hoisting a load attached to the load carrying units (3, 4).

The first driving unit (25), the second driving unit and the third driving unit are powered by a motor (6).

In the embodiment shown in this figure, the load carrying units (3, 4) comprise steel lines (22) with cable ends (26). Strap ends are also suitable instead of cable ends. The steel lines (22) are fixed to fixing elements (23) located in each end of the support beam (2), and they are structured to be released or stowed in a reel (24) which is driven by the third driving unit. The cable ends (26) are suitable for being attached to a load and to be connected to the steel lines (22). The steel lines (22) are structured to transmit the force produced by the third driving unit to the cable ends (26) and then hoist a load which is attached to the cable ends (26). Synthetic straps are also suitable instead of steel lines (22).

The hooking structure (21) is structured to be attached to the core of the support beam (2). In this example the hooking structure (21) comprises a hooking point (13) and a protective structure (20).

The hooking point (13) is structured to receive a hook from a crane. The protective structure (20) protects the hooking structure (21) from any impact that the load hoisting device (1) could receive during its operation.

The processing unit of the hoisting load device (1) is structured to receive the instructions from an operator, and to receive information from the sensor unit. They are also structured to process all the information received and to send instructions to the first, second and third driving unit.

In the following examples a more detailed explanation of the adjustment and manipulation of the load (9) is shown:

Load Adjustment

FIGS. 2.1 to 2.4 schematically illustrate one possible use of a load hoisting device according to the invention.

In FIG. 2.1 the load hoisting device (1) comprises two first driving units (25) structured to act on each load carrying unit (3, 4), to pull or release the load (9). The load hoisting device (1) is hooked from a crane (not shown) through the hooking point (13). The movable counterweight (5) is situated in the middle point of the support beam (2). The load hoisting device (1) further comprises a sensor unit 38, 39 and a processing unit 41. In FIG. 2.1, load (9) rests in a pair of bases (14). Load hoisting device (1) further comprises a second driver (125) structured to make the counterweight (5) slide along the support beam (2), and a third driver (126) structured to hoist the load (9).

The alignment of the centre of mass comprises several steps:

the second driving unit acts on the load carrying units (3, 4) to pull (16) the load (9) (shown in FIG. 2.1.), the sensor unit measures the forces held by the load carrying units (3, 4); as the centre of mass (12) of the load (9) is not aligned between the load carrying units (3, 4), the load carrying units (3, 4) bear different loads (shown in FIG. 2.2.), the processing unit receives the data from the sensor unit and calculates the position in which the counterweight (5) would compensate the offset in the centre of mass (12) of the load (9) (shown in FIGS. 2.2. and 2.3.), and then send instructions to the second driving unit to move (15) the counterweight (5) to this position, such that the centre of mass of the system containing the load (9) and the hoisting device (1) is vertically aligned with the hooking point (13), which is shown in FIG. 2.4.

When the counterweight (5) is in its final position, the centre of mass of the system consisting of the load (9) and the hoisting device (1) is vertically aligned with the hooking point (13). In this situation, any operator can work safely onto the load, as sudden oscillations are avoided by the use of this load hoisting device.

Load Hoisting

FIG. 3 schematically illustrates the case of hoisting one load (9). To perform this action, a load adjustment according to the preceding section is first performed. Once the counterweight (5) is located in the necessary place, the instruction to hoist the load (9) makes the second driving unit to act over the load carrying units (3, 4) to pull (16) the load (9). As the centre of mass of the system is aligned with the hooking point (13), the load hoisting is performed without oscillations.

In the event that the movement produces an inclination of the support beam (2), the processing unit calculates the new position where the counterweight (5) compensates said inclination, and activates the second driving unit to move the counterweight (5) to this position.

Load Lateral Movement

Another possible use of a load management device according to the invention is schematically illustrated by FIGS. 4.1 and 4.2. The processing unit activates the first driving unit (25), which moves (17) the load carrying units (3, 4) along the support beam (2) resulting in the load (9) being moved to the desired position.

The movement of the load (9) implies a movement of the centre of mass (12) which produces an inclination of the support beam (2) due to the offset of the centre of mass of the system containing the load (9) and the hoisting device (1).

As a consequence, the sensor unit, which in this embodiment is periodically sensing the forces held by the load carrying units (3, 4) and the tilt of the support beam (2), detects said tilt variation and send this information to the processing unit. Then the processing unit calculates in which position the counterweight (5) has to be situated to compensate said inclination. Finally, the processing unit activates the second driving unit that moves (15) the counterweight (5) until the centre of mass of the system consisting of the load (9) and the hoisting load device (1) is aligned with the hooking point (13).

This way of use is carried out in the same way in case of an operator decides to return the load (9) to the initial position shown in FIG. 3.

Load Situation in a Determined Angle ($\alpha$)

In this possible use of a load hoisting device according to the invention, the initial position of the load (9) is the one shown in FIG. 3. When tilting instructions are received, the processing unit activates the first driving unit (25) to act on the load carrying units (3, 4) so that the load (9) is placed forming an angle ($\alpha$) with respect to the support beam (2) as it is shown in FIG. 5.

In the event that the sensor unit detects that this movement produces an inclination of the support beam (2), the sensor unit sends this information to the processing unit and the processing unit calculates the position where the counterweight (5) compensates the offset of the centre of mass (12) of the load (9). Then, the processing unit activates the second driving unit, which moves the counterweight (5) position along the support beam (2) until the centre of mass of the system consisting of the load (9) and the hoisting load device (1) is aligned with the hooking point (13).

Load Unloading

In another possible use of a load hoisting device according to the invention, the initial position of the load (9) is the one shown in FIG. 3. When unload instructions are received, the processing unit activates the first driving unit (25) that make the load carrying units (3, 4) lower the load (9), as it is shown in the FIG. 6.1.

In the event that the sensor unit detects that this movement produces an inclination of the support beam (2), the sensor unit sends this information to the processing unit, and the processing unit calculates the position where the counterweight (5) compensates the offset of the centre of mass (12) of the load (9). Then, the processing unit activates the second driving unit, which moves the counterweight (5) position along the support beam (2) until the centre of mass of the system consisting of the load (9) and the hoisting load device (1) is aligned with the hooking point (13), as it is shown in the FIGS. 6.1 to 6.3.

In FIG. 6.4, it is shown how the load rests safety in the bases (14). This operation avoids oscillations and avoids any collisions with any operator or device located in the area.

The invention claimed is:

1. A hoisting device for hoisting a load, the hoisting device comprising:

a support beam, first and second load carriers, structured to be slid longitudinally relative to the support beam and being structured to hold the load, the first load carrier including a first sensor configured to measure the weight force held by the first load carrier and the second load carrier including a second sensor configured to measure the weight force held by the second load carrier, at least one counterweight structured to be slid longitudinally relative to the support beam, a first driver structured to make the first and second load carriers slide along the support beam, a second driver structured to make the counterweight slide along the support beam, a third driver structured to hoist the load, a hooking point structured to be hooked from a crane, and a processor structured to receive weight force information produced by the first and second sensors and structured to operate the first driver, the second driver and the third driver, to move the counterweight to a position such that the centre of mass of a system containing the load and the hoisting device is vertically aligned with the hooking point.

2. The hoisting device according to claim 1, wherein the support beam further comprises, a first rail, the first and second load carriers being slidably arranged to said first rail, and a second rail, the counterweight being slidably arranged to said second rail.

3. The hoisting device according to claim 2, wherein the second rail is located in the opposite side of the support beam with respect of the first rail.

4. The hoisting device according to claim 2, wherein the first rail extends along substantially the whole length of the support beam.

5. The hoisting device according to claim 2, wherein the second rail extends along substantially the whole length of the support beam.

6. The hoisting device according to claim 1, wherein the hooking point is comprised in a hooking structure, which also comprises a protective structure.

7. The hoisting device according to claim 1, wherein the first and second movable load carriers are slings or cables.

8. The hoisting device according to claim 1, further comprising a third sensor structured for sensing position, or levelling or a combination thereof.

9. The hoisting device according to claim 1, wherein each of the first driver, the second driver and the third driver is powered by a motor.

* * * * *